US005170862A

United States Patent [19]

Chang

[11] Patent Number: 5,170,862

[45] Date of Patent: Dec. 15, 1992

[54] LOCKING DEVICE FOR BIDIRECTIONALLY FOLDABLE STEP LADDERS

[76] Inventor: Wan-Li Chang, No. 66, Lane 142, Sec. 1, Yung An Nan Rd., Lu Chou Hsiang, Taipei Hsien, Taiwan

[21] Appl. No.: 880,891

[22] Filed: May 8, 1992

[51] Int. Cl.[5] ..... E06C 1/00

[52] U.S. Cl. ..... 182/159; 182/156

[58] Field of Search ..... 182/156, 159, 160, 157, 182/152

[56] References Cited

U.S. PATENT DOCUMENTS

| | | | |
|---|---|---|---|
| 958,732 | 5/1910 | Dennis | 182/160 |
| 1,054,108 | 2/1913 | Garraway | 182/160 |
| 1,371,125 | 3/1921 | Speckman, Jr. | 182/160 |
| 3,084,760 | 4/1963 | Lamberti | 182/160 |
| 4,560,030 | 12/1985 | Mucelli | 182/160 X |
| 4,842,099 | 6/1989 | Collet et al. | 182/160 |

*Primary Examiner*—Blair M. Johnson

*Attorney, Agent, or Firm*—Weingarten, Schurgin, Gagnebin & Hayes

[57] ABSTRACT

A locking device for preventing bidirectionally foldable step ladders from folding when in an unfolded position, the step ladders being the type including two pairs of U-shaped side rails and a plurality of foldable steps linked by braces to a plate slidably received within respective side rails. The locking device is pivotally attached within a side rail and co-operates with a bracket fixed to the plate to prevent the plate from moving upward when the step ladder is unfolded.

2 Claims, 6 Drawing Sheets

LOCKING DEVICE FOR BIDIRECTIONALLY FOLDABLE STEP LADDERS

BACKGROUND OF THE INVENTION

The present invention relates to locking devices and more particularly to locking devices for use on ladders which fold in two directions.

The inventor of the present invention has a pending U.S. patent application Ser. No. 07/822,862; filed on Jan. 21, 1992 which discloses a bidirectionally foldable step ladder. On a step ladder of this type it is desirable to have a locking device to insure that the step ladder does not accidentally fold with respect to a width thereof. In said application, the inventor discloses one such locking device.

However, as a result of further development, the inventor has innovated a further improved locking device for step ladders of this type.

SUMMARY OF THE INVENTION

The present invention provides a locking device for bidirectionally foldable step ladders. The locking device is disposed in a side rail of the step ladder and mechanically communicates with foldable steps thereof. The locking device prevents the foldable steps from pivoting and folding, thereby preventing the entire step ladder from folding.

Accordingly, it is a main object of the present invention to provide a locking device for a bidirectionally foldable step ladder which prevents the step ladder from folding when in an unfolded position.

It is another object of the present invention to provide a locking device for a bidirectionally foldable step ladder which is easily manipulated by a user.

For a batter understanding of the present invention and for a realization of these as well as additional objects, a study should be made to the following detailed description with reference to the accompanying drawings.

DETAILED DESCRIPTION OF THE PREFERRED EMBODIMENT

Figure 1:
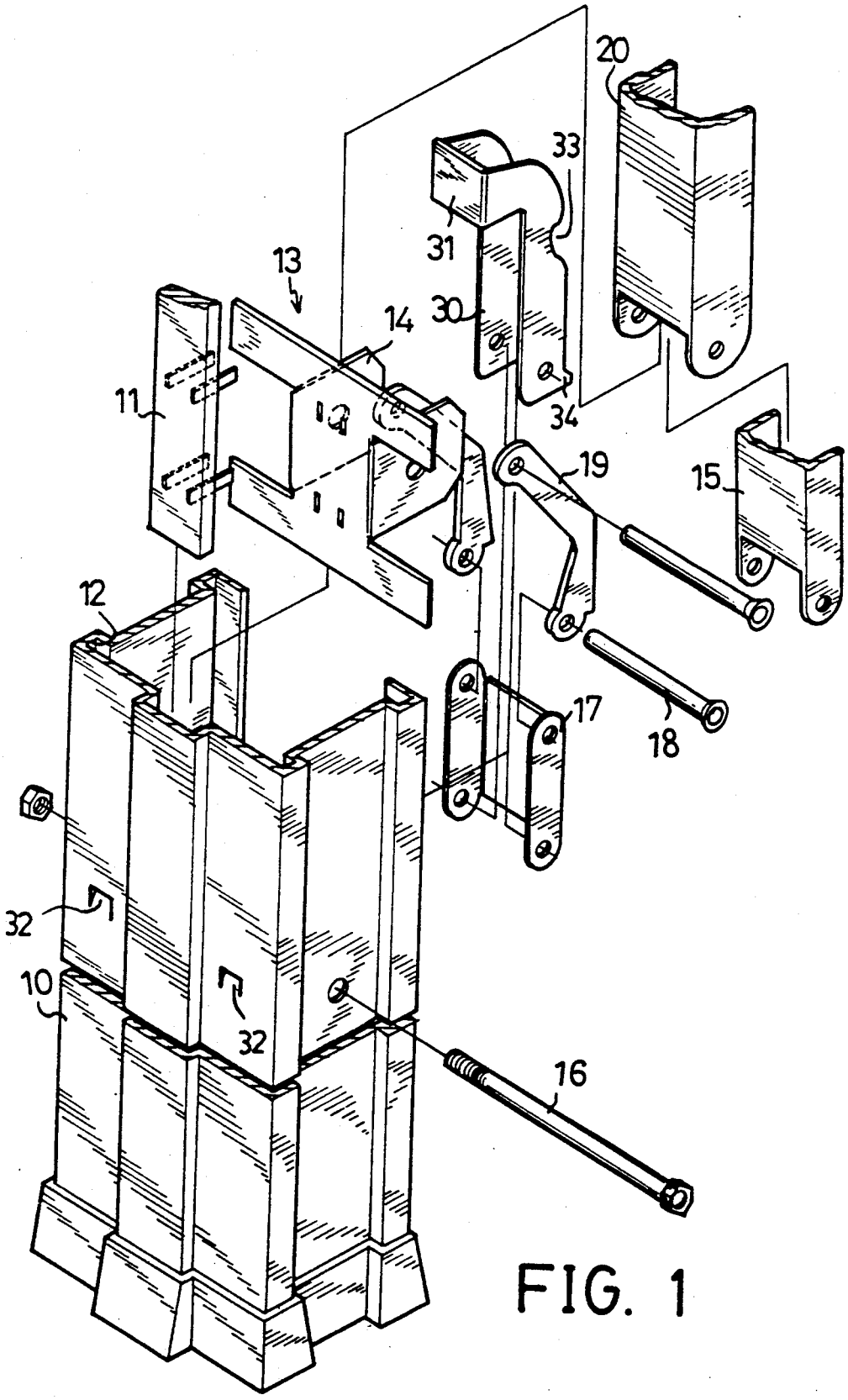
FIG. 1 is an exploded view of a locking device for bidirectionally foldable step ladders in accordance with the present invention.
Figure 2:
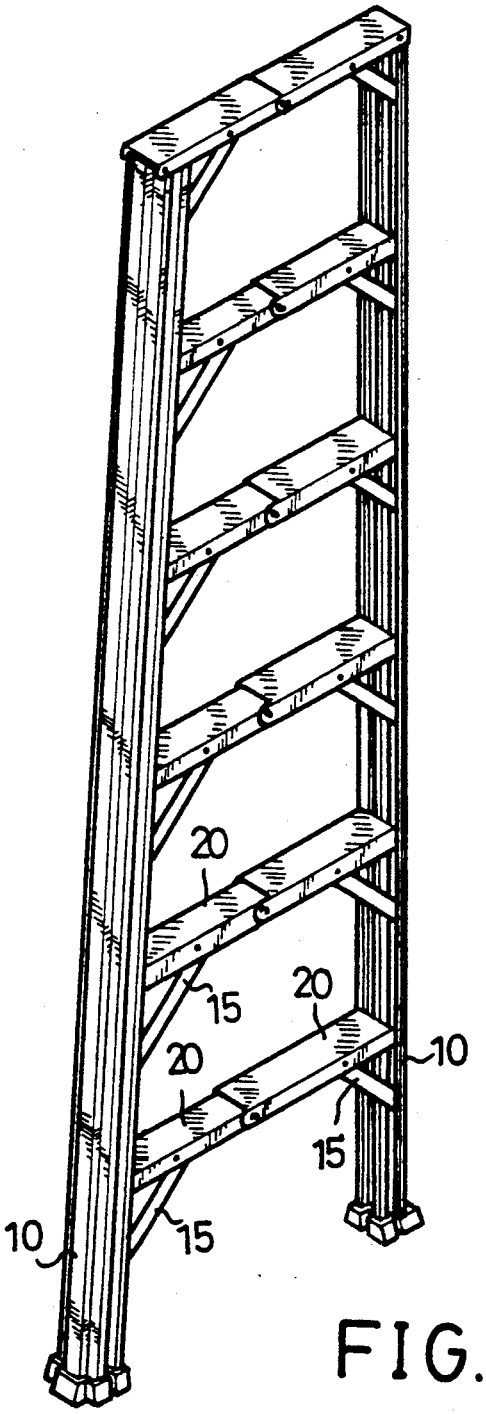
FIG. 2 is a perspective view of one-half of a bidirectionally foldable step ladder which highlights foldable steps and a pair of side rails thereof, shown in an unfolded position.
Figure 3:
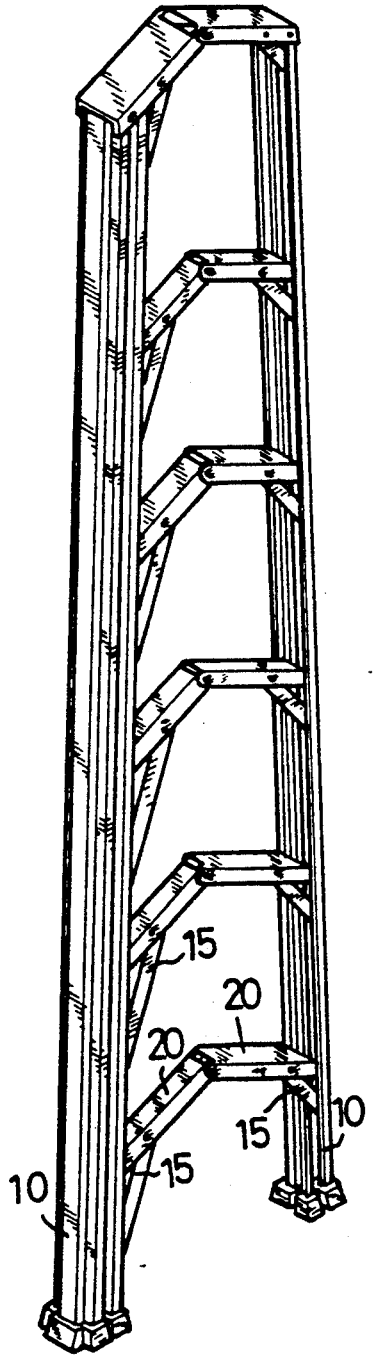
FIG. 3 is a view similar to FIG. 2, shown in a folding position.

Referring to the drawings, particularly to FIG. 1 and generally to FIGS. 2 and 3, a locking device in accordance with the present invention is disposed in a substantially U-shaped shaped side rail 10 of a bidirectionally foldable step ladder. The step ladder generally comprises a plate 11 which is slidably received in a spinal slot formed in the side rail 10. Slidably received within a slot 12 (also formed in the side rail 10) is a bracket 13 which is fixed to the plate 11 by suitable fixing means. The bracket 13 has a pair of flanges 14 protruding therefrom between which a brace 15 is pivotally attached (clearly shown in FIG. 4). A foldable step 20 is pivotally attached to the side rail 10 and to which the brace 15 is pivotally attached. As can be realized, the bracket 13, the brace 15, and the foldable step 20 are disposed in corresponding pluralities, as seen in FIGS. 2 and 3.

Figure 4:
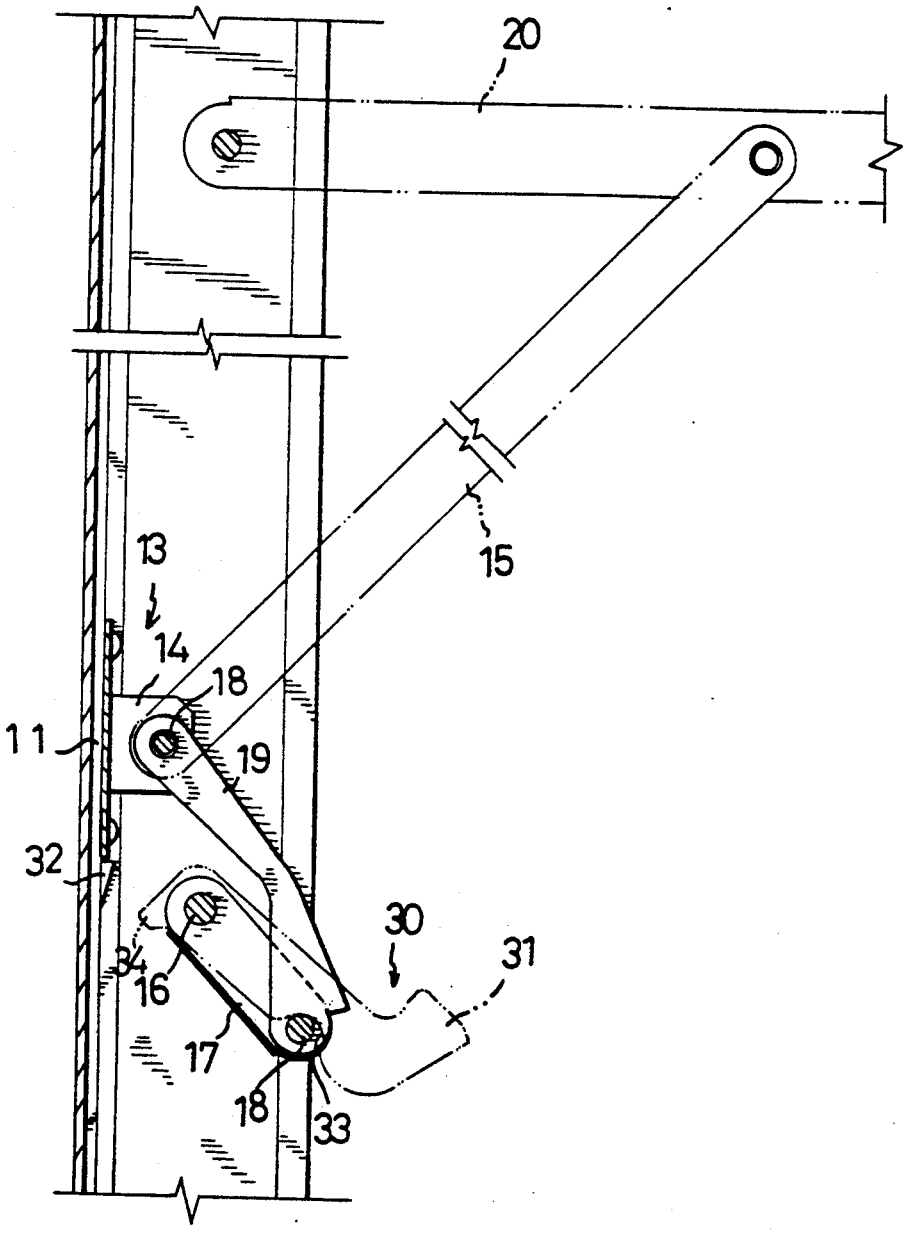
FIG. 4 is a cross-sectional view of the locking device, shown in an unlocked position (the step ladder shown in the unfolded position)

More specifically, additionally referring to FIG. 4, the locking device according to the present invention comprises a pivotal element 17 pivotally attached by a bolt 16 within the side rail 10. The pivotal element 17 is substantially U-shaped, being defined by a flat portion having two side portions perpendicularly protruding therefrom. A pair of linking arms 19 are pivotally attached respectively to the flanges 14 and the pivotal element 17. The linking arms 19 are substantially dog-legged shaped. A handle 30 is pivotally received on the bolt 16 at one end thereof and has a finger portion 31 formed on the other end thereof. The handle 30 is receivable within the pivotal element 17. At least one stop 32 is formed on the side rail 10 for preventing downward movement of the bracket 13 at a position yielding the foldable step 20 horizontally disposed.

Figure 5:
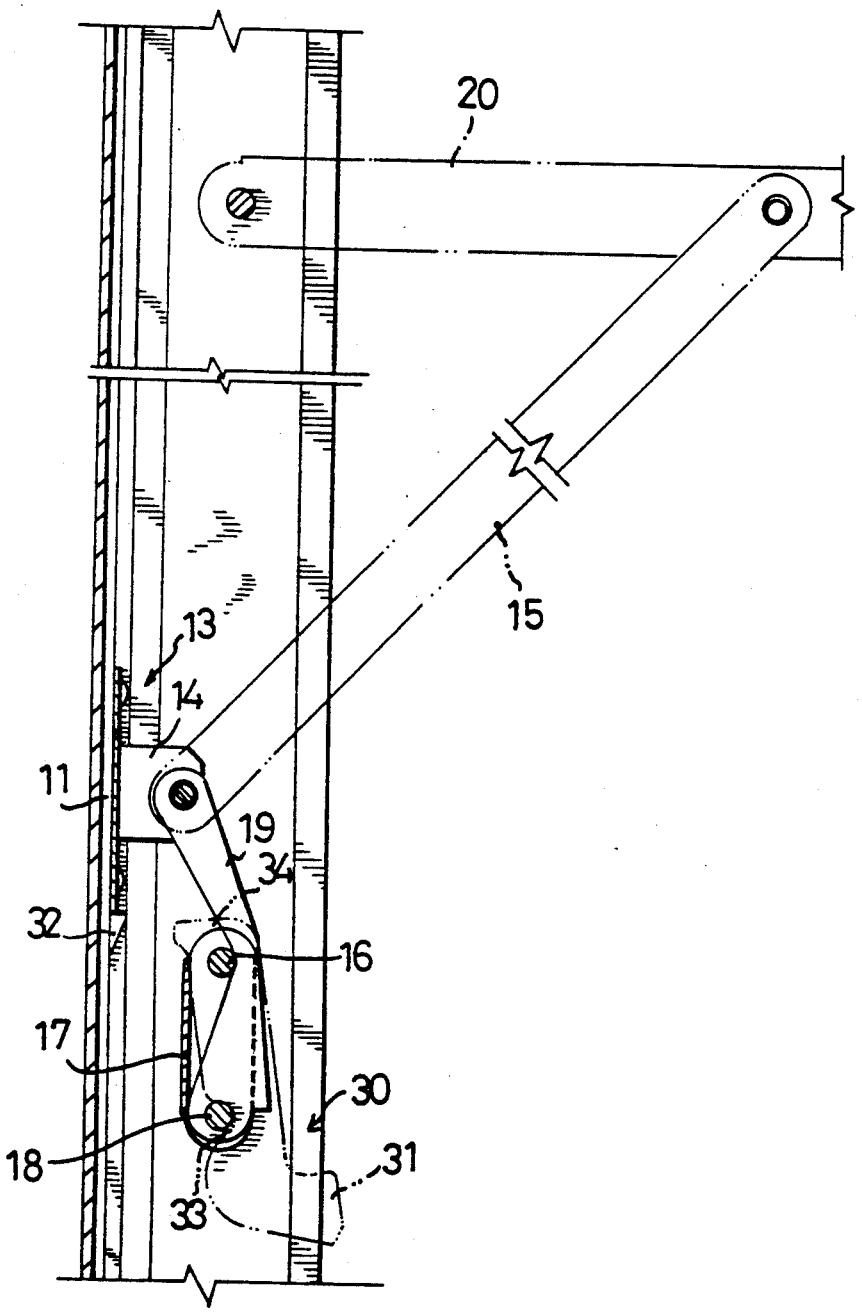
FIG. 5 is a view similar to FIG. 4, shown in a locked position (the step ladder shown in the unfolded position)
Figure 6:
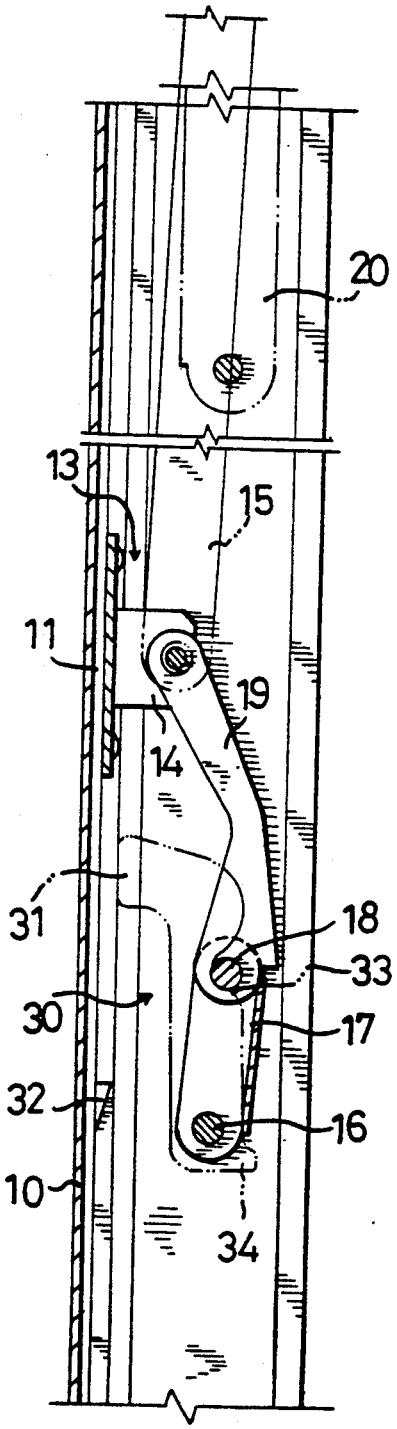
FIG. 6 is another view similar to FIG. 4, shown in an unlocked position (the step ladder shown in a folded position).

Specifically referencing FIGS. 4, 5, and 6, when the step ladder is in an unfolded position and it is desired to prevent the ladder from folding, i.e., to lock the ladder, the handle 30 is urged toward the side rail 10, i.e., clockwise, contacting the pin 18 and urging the pivotal element 17 clockwise. The length of the linking arms 19 is slightly less than the radius of rotation of the path defined by the movement of the pin 18 at the position shown in FIG. 4, i.e., nears a plane defined by the pin 18 common to the flanges 14 and the linking arms 19 and by the bolt 16, such that the handle 30 has to be urged past this plane, thereby "snapping" into the position shown in FIG. 5 and preventing the bracket 13 and the plate 11 from moving upward. From this Figure it can be seen that the angle in the linking arms 19 created by the dog-shape accommodates for the position of the bolt 16 while also providing a certain amount of elasticity for the snapping action. Furthermore, the handle 30 may have a recessed portion 33 which accommodates the pin 18 linking the pivotal element 17 and the linking arms 19.

Accordingly, to unlock the locking device to fold the step ladder, the handle 30 is urged counterclockwise. A lip 34 is formed on the handle 30 which contacts the flat portion of the pivotal element 17 near the bolt 16, such that as the handle is rotated, the lip 34 urges the pivotal element 17 to rotate likewise, snapping past the plane defined and described above with reference to FIG. 4. FIG. 6 illustrates the pivoted position of the locking device when the step ladder is in a folded position. It can be seen that the locking device is entirely received within the side rail 10.

Accordingly, it is to be understood that even though numerous characteristics and advantages of the present invention have been set forth in the foregoing description, together with details of the structure and function of the invention, the disclosure is illustrative only, and changes may be made in detail, especially in matters of shape, size, and arrangement of part within the principles of the invention to the full extent indicated by the broad general meaning of the terms in which the appended claims are expressed.

What is claimed is:

1. A locking device for preventing bidirectionally foldable step ladders from folding, the step ladders being of the type including a pair of substantially U-shaped side rails, a plurality of foldable steps being pivotally attached to and disposed between the side rails, a corresponding plurality of braces being respectively pivotally attached to the foldable steps, a plate being slidably received in a spinal slot formed in each side rail, a bracket having a pair of flanges and being slidably received within a transverse slot also formed in each side rail and fixed to the plate by suitable fixing means, said locking device comprising:

a pivotal element being defined by a flat portion having two side portions perpendicularly protruding therefrom;

a bolt pivotally attaching said pivotal element within one of the side rails and defining a transverse axis of rotation for said pivotal element at a first end thereof;

a pair of linking arms being respectively pivotally attached to the flanges of the bracket and to said pivotal element at a second end thereof by a pin, said linking arms being substantially dog-legged shaped, a length of said linking arms being slightly less than a radius of rotation of a path defined by movement of said pin;

a handle being pivotally received on said bolt at one end thereof and having a finger portion formed on the other end thereof for manipulation by a user, said handle being receivable within said pivotal element between said side portions thereof; and at least one stop being formed on the side rail for preventing downward movement of the bracket at a position yielding the foldable steps horizontally disposed.

2. A locking device as claimed in claim 1, wherein a lip is formed on said handle which contacts said flat portion of said pivotal element near said bolt, whereby when said handle is rotated, said lip urges said pivotal element to rotate likewise.

* * * * *